US008491070B2

(12) United States Patent
Davis et al.

(10) Patent No.: US 8,491,070 B2
(45) Date of Patent: Jul. 23, 2013

(54) REFRIGERATOR DOOR POCKET HINGE ASSEMBLY

(75) Inventors: Matthew William Davis, Prospect, KY (US); Wayne Edward Lawson, La Grange, KY (US); Scott Gabriel Brown, Louisville, KY (US)

(73) Assignee: General Electric Company, Schenectady, NY (US)

( * ) Notice: Subject to any disclaimer, the term of this patent is extended or adjusted under 35 U.S.C. 154(b) by 170 days.

(21) Appl. No.: 12/897,058

(22) Filed: Oct. 4, 2010

(65) Prior Publication Data

US 2012/0080989 A1 Apr. 5, 2012

(51) Int. Cl.
*A47B 96/04* (2006.01)

(52) U.S. Cl.
USPC ..... 312/405; 312/326

(58) Field of Classification Search
USPC ..... 312/326–329, 405; 16/221, 236–237, 16/240, 245, 250–251
See application file for complete search history.

(56) References Cited

U.S. PATENT DOCUMENTS

| | | | | |
|---|---|---|---|---|
| 2,309,001 | A * | 1/1943 | Nave et al. | 49/398 |
| 2,674,761 | A * | 4/1954 | Weiss | 16/288 |
| 2,866,675 | A * | 12/1958 | Kesling | 312/405 |
| 2,975,013 | A * | 3/1961 | Wallace et al. | 312/296 |
| 3,320,699 | A * | 5/1967 | Carson et al. | 49/388 |
| 3,523,323 | A * | 8/1970 | Jorgensen | 16/302 |
| 5,497,534 | A * | 3/1996 | Caruso | 16/288 |
| 5,931,554 | A * | 8/1999 | Koopman | 312/405 |
| 6,845,545 | B2 * | 1/2005 | Han et al. | 16/277 |
| 7,992,951 | B2 * | 8/2011 | Kim et al. | 312/405 |
| 8,079,114 | B2 * | 12/2011 | Fries et al. | 16/243 |
| 2005/0212392 | A1 * | 9/2005 | Jung | 312/405 |
| 2006/0017361 | A1 * | 1/2006 | Rendel et al. | 312/405 |
| 2009/0284116 | A1 | 11/2009 | Gorz et al. | |

FOREIGN PATENT DOCUMENTS

| | | | |
|---|---|---|---|
| GB | 2410059 | A * | 7/2005 |
| WO | WO 2007/031469 | A1 * | 3/2007 |

* cited by examiner

*Primary Examiner* — Hanh V Tran
(74) *Attorney, Agent, or Firm* — Dority & Manning, P.A.

(57) ABSTRACT

A refrigerator is provided with a casing in the form of a shell that defines an internal storage compartment, such as a freezer or fresh-food section. A door is configured on the casing to provide access to the storage compartment, with the door closing on front edges of the casing. A hinge assembly connects the door to the casing and includes a hinge bracket having an insert end that extends through one of the front edges, for example the top front edge, and is fixed to an internal surface of the casing. The hinge bracket has an opposite end that is rotationally connected to the door for hinged support of the door on the casing.

11 Claims, 3 Drawing Sheets

REFRIGERATOR DOOR POCKET HINGE ASSEMBLY

FIELD OF THE INVENTION

The present subject matter relates generally to door hinges, and more particularly to a refrigerator door hinge assembly.

BACKGROUND OF THE INVENTION

Various styles of conventional refrigerators (e.g., a side-by-side refrigerator) typically have one or more vertically oriented doors to provide access to the internal storage compartments of the appliance. The top hinge assemblies for these doors usually include a hinge bracket that is mounted to the top wall of the refrigerator casing adjacent to the side of the refrigerator. The bracket extends laterally outward from the casing and mates (via a hinge pin) with a receiver in the corresponding hinge component mounted to the door. The bracket may have a stepped profile to accommodate the door height.

The externally mounted brackets on the top of the refrigerator casing are readily visible and detract from the overall aesthetics of the appliance. In this regard, caps or other decorative devices are commonly attached over the brackets to mask their appearance. With other conventional designs, the height of the refrigerator doors is increased to extend above the top of the casing so as to hide the hinge components when the door is closed. The height of the brackets and attached caps above the top surface of the casing or increased height of the doors, are thus the limiting design height restraints of the refrigerator. Any space in a cabinet, wall, or other enclosure structure in which the refrigerator is located must have a vertical height so as to accommodate the brackets/caps or increased door height. The additional volume of space required to accommodate the brackets/caps or doors can be substantial and is essentially wasted.

U.S. Pat. Pub. No. 2009/0284116 describes a refrigerator having a reinforcement frame attached to the appliance housing. The door hinges are secured to the reinforcement frame and may be housed in a recessed pocket formed in the frame. This type of reinforcement structure is generally not applicable or reasonable for conventional residential refrigerator designs.

Accordingly, it would be desirable to provide a refrigerator hinge assembly that hides the hinge brackets and makes efficient use of the additional volume of space needed to accommodate the brackets.

BRIEF DESCRIPTION OF THE INVENTION

Aspects and advantages of the invention will be set forth in part in the following description, or may be obvious from the description, or may be learned through practice of the invention.

In an exemplary embodiment, a refrigerator is provided with a casing in the form of a shell that defines an internal storage compartment, such as a freezer section or fresh-food section. A door is configured on the casing to provide access to the storage compartment, with the door closing on front edges of the casing. A hinge assembly connects the door to the casing and includes a hinge bracket having an insert end that extends through one of the front edges, for example the top front edge, and is fixed to an internal surface of the casing. The hinge bracket has an opposite end that is rotationally connected to the door for hinged support of the door on the casing.

In a further embodiment, a refrigerator is provided with a casing defining an internal storage compartment. The casing has a top wall defining a top front edge. A door is attached on the casing with a hinge assembly to provide access to the storage compartment. The hinge assembly includes a slot defined in the top front edge of the casing. The hinge assembly includes a hinge bracket having an insert end fitted into the slot and an opposite end rotationally connected to the door. The insert end is attached within the casing, for example with fasteners disposed through a top wall surface of the casing adjacent to the top front edge. With this unique configuration, no portion of a hinge bracket or associated cap is located on the top of the refrigerator casing and, thus, the design height of the casing need not be reduced in order to accommodate for any such structure on the top of the casing. The increase in casing height may be used to increase the internal volume of the storage compartment, for additional insulation material within the casing, or any other reason.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
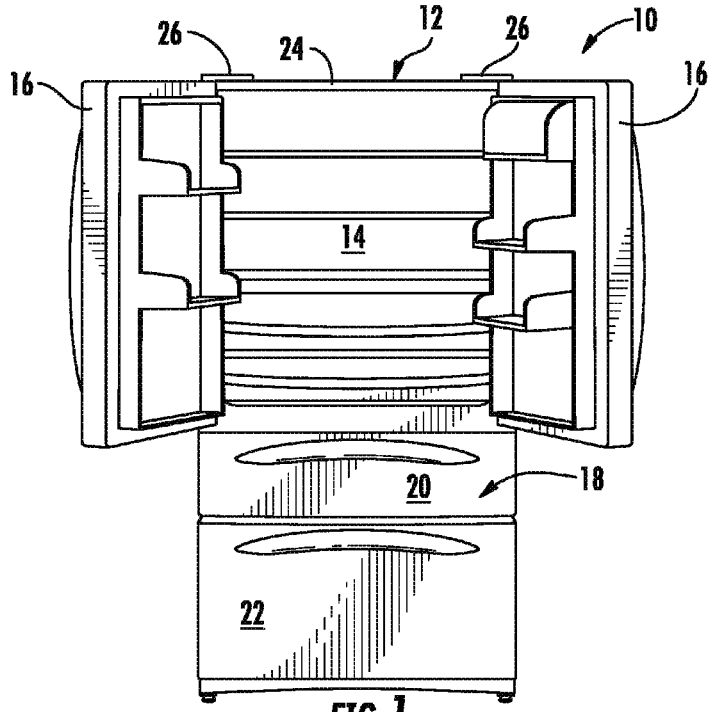
FIG. 1 (PRIOR ART)
FIG. 1 is a front view of a conventional refrigerator having hinge brackets mounted to the top of the refrigerator casing.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts a conventional refrigerator 10. It should be appreciated that the term "refrigerator" is used in a generic sense herein to encompass any manner of refrigeration appliance, including a freezer, refrigerator/freezer combination, and any style or model of conventional refrigerator. In the illustrated embodiment, the refrigerator 10 is depicted as an upright refrigerator having a casing 12 (including top casing wall 24) that defines any number of internal storage compartments. For example, the illustrated refrigerator 10 includes upper fresh-food compartment 14 having doors 16 and lower freezer compartment 18 having upper pull-out drawer 20 and lower pull-our drawer 22. The doors 16 are mounted to the casing 12 by way of lower and upper hinge brackets (not visible in FIG. 1). The upper hinge brackets are mounted to the top surface of the top casing wall 24. Decorative caps 26 are typically placed over the brackets, as is well known in the art, to mask the appearance of the brackets.

It can be appreciated from FIG. 1 that the design height dimension of the refrigerator 10 must include the height of the caps 26 (and underlying hinge brackets) above the top casing wall 24. Any type of cabinet, enclosure, wall recess, or the like, in which the refrigerator 10 is intended to be placed must accommodate the height of the caps 26, which results in a noticeable space between the top wall 24 and the cabinet or other structure, with the caps 26 (and underlying hinge brackets) readily visible in this space.

Figure 2:
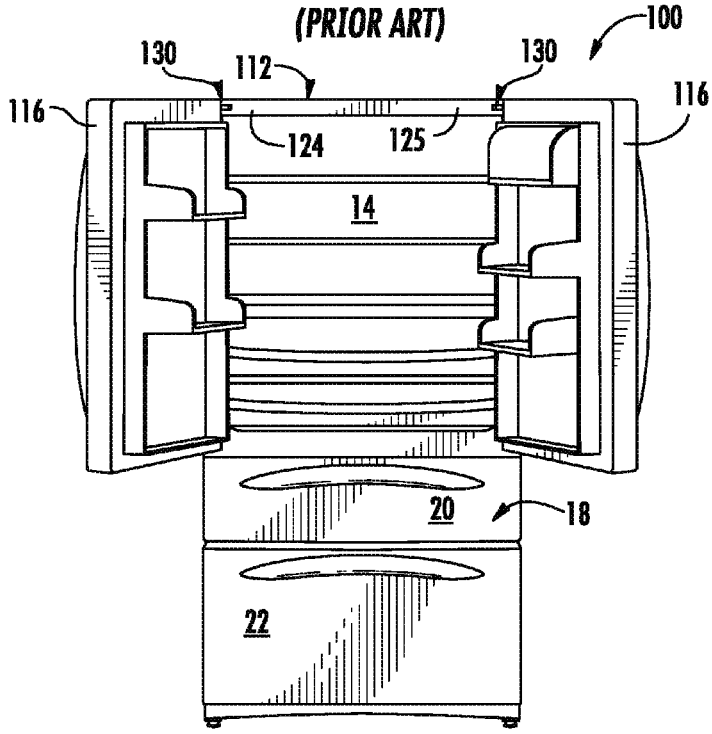
FIG. 2 is a front view of a refrigerator having a pocket hinge assembly in accordance with aspects of the invention.
Figure 3:
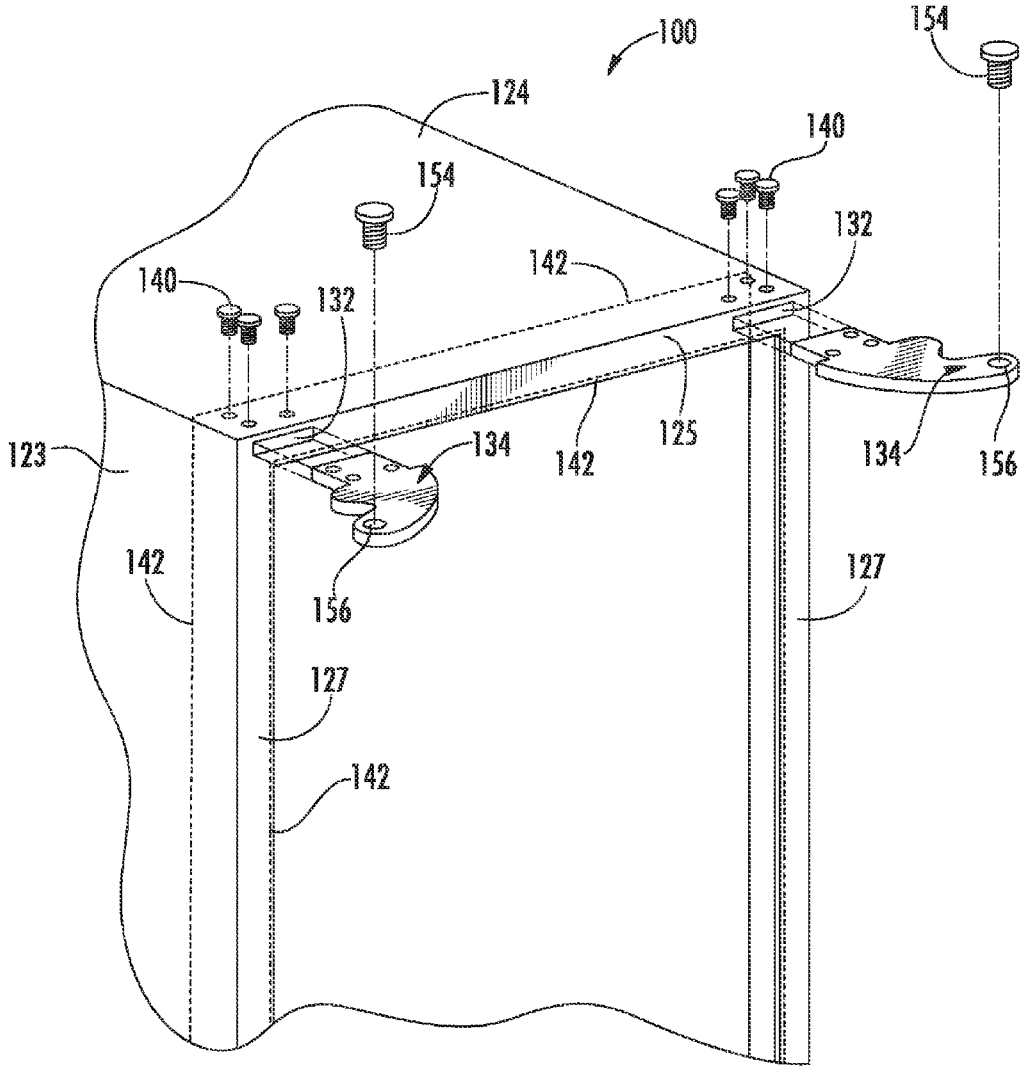
FIG. 3 is a partial perspective view of a refrigerator casing with an embodiment of a pocket hinge assembly.

FIG. 2 depicts a refrigerator 100 that incorporates hinge assemblies 130 in accordance with aspects of the invention to mount the doors 116 to the casing 112, particularly to the top wall 124 of the casing 112. The casing 112 may be a conventional design wherein an outer sheet metal case is formed around one or more inner liners that define the internal compartments of the refrigerator 100. For example, a piece of sheet metal may be formed into a U-shape to define the outer top and sides of the casing 112, with folded edge portions defining the front face edges of the casing 112, including the top front edge 125 and side front edges 127 (FIG. 3). A bottom wall is normally formed separately and attached to sidewalls of the metal case and a bottom frame. The liners may be molded from a suitable plastic material to form the fresh food compartment 14 and freezer compartment 18. The liners may also be formed from a suitable metal. The space between the sheet metal case and liners is typically filled with foam or other suitable insulation.

The bracket components 134 (FIG. 3) of the hinge assemblies 130 are disposed at least partially within the top wall 124 of the casing and, thus, the upper surface of the top wall 124 defines the design height of the refrigerator 110. The design height can thus be increased to occupy the space that was previously needed for the caps 26 and underlying brackets (or increased door height) in the conventional design of FIG. 1. This height increase may provide an increased internal volume to the fresh-food compartment 14. Alternatively, the top wall 124 may have a wider (vertical aspect) front edge 125 and proportionately larger internal volume 166 (FIG. 4) as compared to the top wall 24 of the conventional design of FIG. 1. This increased volume may be used for various purposes, including additional insulation material between the sheet metal case and liner along the top wall 124.

Referring to FIGS. 2 through 5 in general, the hinge assemblies 130 include a slot 132 that is defined in the front edge 125 of the top wall 124. As described above, the front edge 125 may be defined by a bent-over portion of the sheet metal used to form the outer case of the top wall 124. The slot 132 is generally defined adjacent to a side wall 123 of the casing 112, or at any other desired location for the hinge assembly 130.

A hinge bracket 134 is provided with an insert end 136 that is configured for insertion into the slot 132 and an opposite end 138 that is configured for hinged attachment to the doors 116 (FIG. 2) by conventional means. For example, the end 138 may include a hinge pin hole 156 through which a hinge pin 154 is used to connect the hinge bracket 134 to a complimentary receiver in a door frame, as is well known by those skilled in the art. A jacket or sleeve 158 may be incorporated with the hole 156, with the hinge pin 154, or in the complimentary receiver in the door frame.

The insert end 136 of the hinge bracket 134 is fastened within the slot 132 by any suitable configuration of fasteners 140. In the illustrated embodiment, the fasteners 140 are illustrated as threaded members, such as screws or bolts, which pass through the top casing wall 124. The fasteners 140 may also pass through the front edge 125. In alternate embodiments, the fasteners 140 may be rivets, welds, and the like. The invention is not limited by any particular type of fasteners 140 used to securely attach the insert end 136 of the hinge bracket 134 within the top wall 124.

A frame reinforcement member 142 may be provided within the casing 112 along the top wall 124, as well as around other portions of the circumference of the casing 112. For example, the reinforcement member 142 may comprise an L-shaped frame member depicted by the dashed lines in FIGS. 3 through 5. This L-shaped frame member is disposed within the internal volume of the casing 112 with an upper leg along an inner surface of the top wall 124 (as well as along an inner surface of the side walls 123) of the casing 112. A perpendicular front leg of the reinforcement member 142 extends along an inner face of the front edge 125 of the top wall 124 and edges 127 of the side walls 123. Thus, the slot 132 is defined through the front leg of the reinforcement member 142 at a location such that the insert end 136 of the hinge bracket 134 extends through the front leg and is disposed against the upper leg of the reinforcement member 142 within the internal volume of the top wall 124, as can be appreciated from FIGS. 3 and 4.

Figure 4:
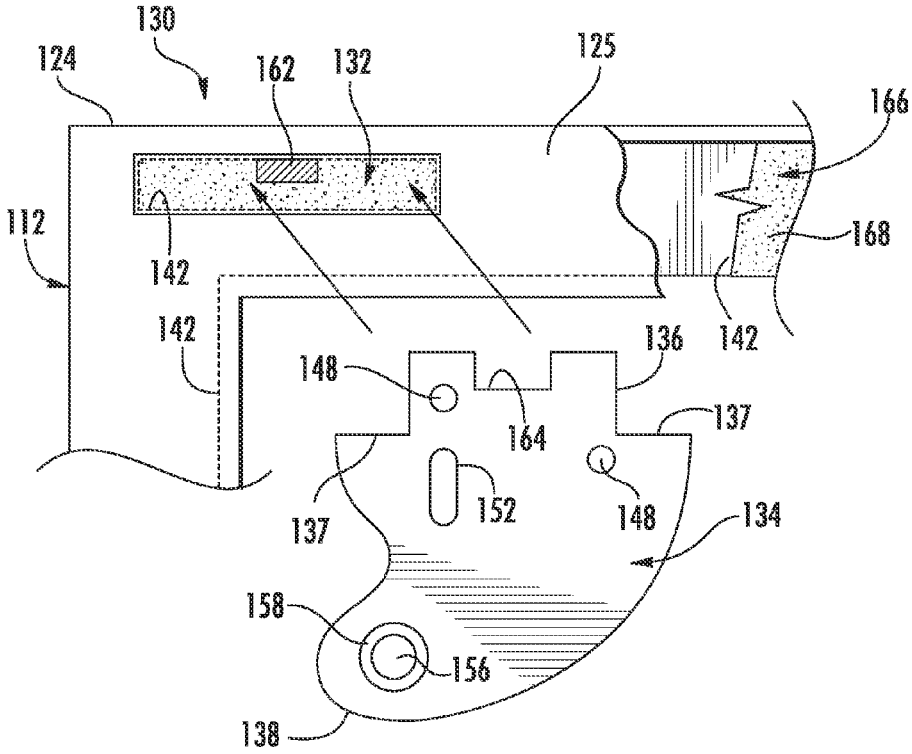
FIG. 4 is front enlarged view of an alternative embodiment of a pocket hinge assembly.

Holes 146 for the fasteners 140 are defined through the top wall 124 and upper leg of the reinforcement member 142. Referring particularly to FIG. 4, it can be appreciated that the top planar surface of the insert end 136 of the hinge brackets 134 is disposed directly against the upper leg of the reinforcement member 142 that extends along the top wall 124, and is drawn against the reinforcement member 142 by the fasteners 140. The frame member 142 provides the desired degree of structural rigidity to the casing 112, as well as a strong structural attachment point for the hinge brackets 130.

Any manner of guide structure may be provided between the hinge brackets 134 and the slot 132 to ensure proper relative location of the hinge brackets 134 within the top wall 124 of the casing 112. For example, in the embodiment of FIGS. 4 and 5, the hinge bracket 134 includes shoulders 137 that essentially define the extent of the insert end 136. The shoulders 137 engage against the front edge 125 of the top wall 124 at the opposite sides of the slot 132. The insert end 136 may also include a notch or other type of slot 164 defined therein that mates with a projection 162 within the slot 132, as depicted in FIG. 4. The projection 162 may be, for example, a bent-down portion of the frame member 142, or a component attached to the frame member 142.

As discussed above, the internal volume 166 (FIG. 4) within the top wall 124 may be increased as compared to the conventional design of FIG. 1 due to increased width of the top front edge 125. This internal volume 166 may be filled with additional insulation material 168, as depicted in FIG. 4. In an alternative embodiment, it should be understood that the top front edge 125 may have essentially the same width as the prior conventional embodiment of FIG. 1, but with the casing 112 having an overall greater height dimension. In this embodiment, the internal compartment of the casing 112 (i.e., the fresh food compartment 14) would thus have an increased volume.

Still referring to FIG. 4, the insulation material 168 may also essentially fill the space in the slot 132 around the hinge brackets 134 and, in this way, serve to further secure the hinge brackets 134 within the slots 132.

Figure 5:
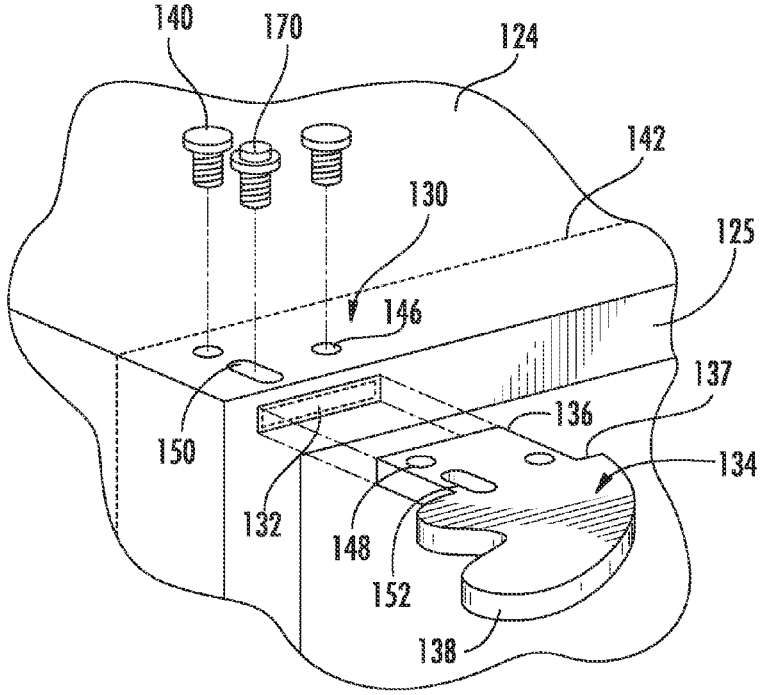
FIG. 5 is a partial perspective view of yet another embodiment of a pocket hinge assembly.

Referring to FIG. 5 in particular, it may be desired to provide a means for relative adjustment of the brackets 134 within the slots 132. In the embodiment illustrated in FIG. 5, a cam bolt 170 extends through an elongated slot 150 defined through the top of wall 124 and underlying leg of the reinforcement member 142. The cam bolt 170 includes a cam surface that will engage within an elongated slot 152 in the hinge bracket 134 to provide a means of relative rotational positioning of the bracket 134 with rotation of the cam bolt 170 so that the fastener holes 148 in the bracket 134 can be aligned with the holes 146 in the top wall 124. Alternatively, the cam bolt 170 may be used for fine-tuning of the position of the bracket 134 within the slot 132 prior to drilling the fasteners holes through the top wall 124 and the brackets 134. It should be appreciated that any other manner of conventional position adjustment device may be utilized between the hinge brackets 134 and the structure of the slot 132 for this purpose.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator, comprising:

a casing defining an internal storage compartment, said casing having a top wall defining a top front edge;

a door configured on said casing to provide access to said storage compartment, said door having a door frame;

a hinge assembly connecting said door to said casing, said hinge assembly comprising a slot defined in said top front edge of said casing at a location so as to be covered by a top member of said door frame in a closed position of said door;

a hinge bracket having an insert end fitted into said slot and an opposite end rotationally connected to said door, said opposite end received in said top member of said door frame such that said top member of said door frame is essentially flush with said top wall of said casing;

said insert end attached to said casing with fasteners disposed through said casing; and further comprising a reinforcement member within said casing that extends against an inner surface of said top front edge, said slot defined through said reinforcement member such that said insert end of said hinge bracket extends through said reinforcement member.

2. The refrigerator as in claim 1, wherein said reinforcement member also extends against an inner face of said top wall of said casing, said insert end of said hinge bracket disposed against said reinforcement member, said fasteners disposed through said reinforcement member.

3. The refrigerator as in claim 1, wherein said hinge bracket further comprises a positioning shoulder defined thereon that delimits said insert end and engages against said top front edge of said casing.

4. The refrigerator as in claim 1, wherein said top wall defines an internal volume, said insert end of said hinge bracket disposed in said internal volume, and further comprising insulation material at least partially filling said internal volume around said insert end of said hinge bracket.

5. The refrigerator as in claim 1, wherein at least one of said fasteners is configured for variable position adjustment of said hinge bracket relative to said slot.

6. The refrigerator as in claim 1, further comprising guide structure within said slot that is engaged by said insert end of said hinge bracket.

7. The refrigerator as in claim 6, wherein said guide structure comprises a projection, said insert end of said hinge bracket comprising a slot that engages said projection.

8. A refrigerator, comprising:

a casing defining an internal storage compartment, said casing comprising front edges;

a door configured on said casing to provide access to said storage compartment, said door comprising a door frame; and a hinge assembly connecting said door to said casing, said hinge assembly comprising a hinge bracket having an insert end that extends through one of said front edges of said casing and is fixed to said casing at a location such that said door frame covers the location in said front edge of said casing in a closed position of said door, said hinge bracket having an opposite end rotationally connected to said door, said opposite end received in said door frame such that said door frame is essentially flush with said front edge of said casing in the closed position of said door;

wherein said door is vertically oriented on said casing, said hinge bracket configured on a top one of said front edges, said insert end of said hinge bracket fastened to said casing with fasteners disposed through a top wall of said casing; and wherein said casing defines an internal volume, and further comprising a reinforcement member within said casing that extends internally against said top front edge and said top wall of said casing, said insert end of said hinge bracket fitted through a slot defined through said top front edge and said reinforcement member.

9. The refrigerator as in claim 8, wherein said hinge bracket further comprises a positioning shoulder defined thereon that delimits said insert end and engages against said top front edge of said casing.

10. The refrigerator as in claim 8, further comprising guide structure within said slot that is engaged by said insert end of said hinge bracket.

11. The refrigerator as in claim 8, wherein said insert end of said hinge bracket is disposed in said internal volume, and further comprising insulation material at least partially filling said internal volume around said insert end of said hinge bracket.

* * * * *